United States Patent [19]

Stobb

[11] Patent Number: 4,747,593

[45] Date of Patent: May 31, 1988

[54] SUPPORT FOR EDGE-STANDING SHEETS

[75] Inventor: Walter J. Stobb, Pittstown, N.J.

[73] Assignee: Stobb Inc., Clinton, N.J.

[21] Appl. No.: 886,374

[22] Filed: Jul. 17, 1986

[51] Int. Cl.[4] ..... B65H 35/04

[52] U.S. Cl. ..... 271/213; 198/626; 271/200; 414/42

[58] Field of Search ..... 271/201, 200, 150, 205, 271/207, 213, 214, 209, 208; 198/626, 628, 699.1; 414/42, 43

[56] References Cited

U.S. PATENT DOCUMENTS

| | | | |
|---|---|---|---|
| 2,841,394 | 7/1958 | Stobb | 271/185 |
| 2,853,298 | 9/1958 | Faeber | 271/214 |
| 2,933,313 | 4/1960 | Stobb | 271/185 |
| 3,521,322 | 7/1970 | Michael et al. | 198/699.1 X |
| 3,718,217 | 2/1973 | Stobb et al. | 271/311 |
| 4,078,647 | 3/1978 | David et al. | 198/626 X |
| 4,172,531 | 10/1979 | Muller | 414/42 |

FOREIGN PATENT DOCUMENTS

| | | | |
|---|---|---|---|
| 2161081 | 6/1971 | Fed. Rep. of Germany | 198/699.1 |

*Primary Examiner*—Andres Kashnikow
*Assistant Examiner*—Matthew C. Graham
*Attorney, Agent, or Firm*—Arthur J. Hansmann

[57] ABSTRACT

An upstanding sheet support system which utilizes either brushes or a jagged configuration member for engaging the opposite sides of sheets standing in a horizontal bundle where the sheets are standing on their edges on a floor. The side support members can either be stationary or moving, for supporting the sheets, and there is no requirement for any other support of the sheets, such as the requirement of the usual backstop, special handling, or binding of the bundle, since the sheets are self-standing by virtue of the spaced-apart engaging the opposite sides of the sheets in the bundle.

4 Claims, 1 Drawing Sheet

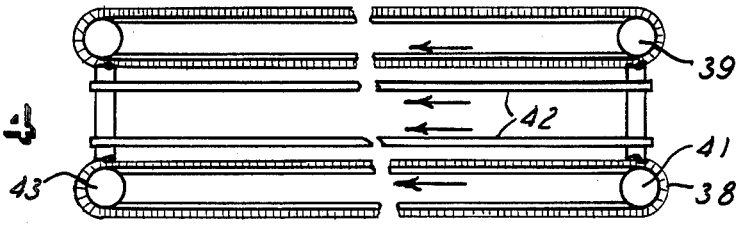
FIG. 4
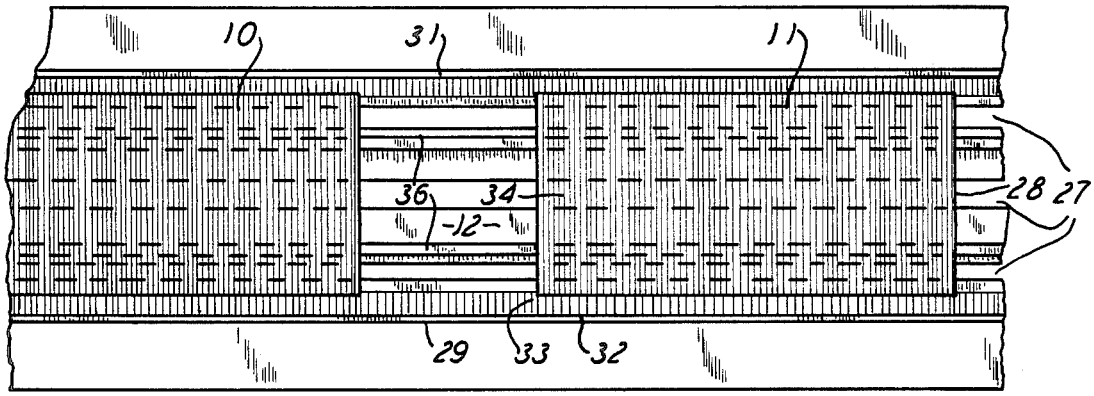
FIG. 2
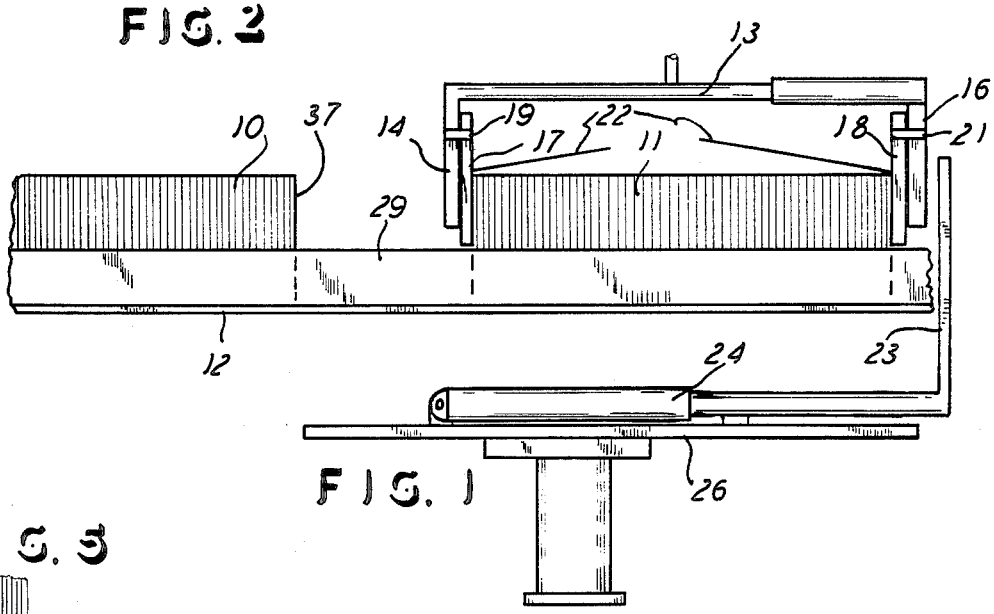
FIG. 1
FIG. 5
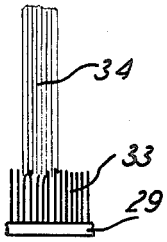
FIG. 6
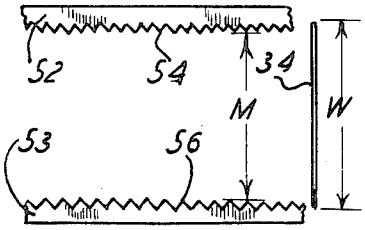
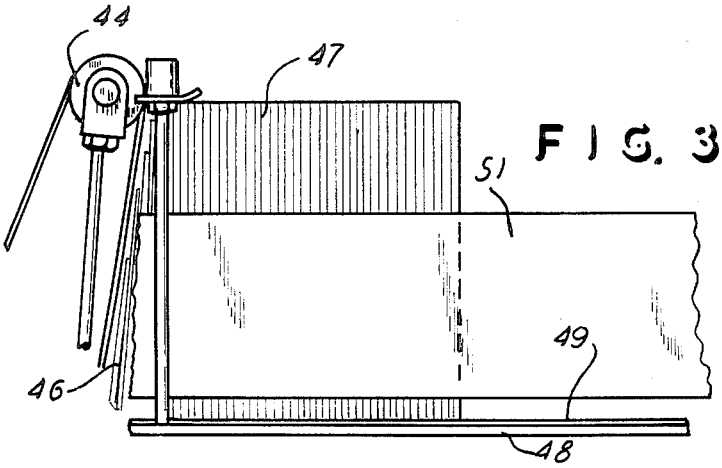
FIG. 3

SUPPORT FOR EDGE-STANDING SHEETS

This invention relates to a support for edge-standing sheets, such as a bundle of sheets which stand on edge and are in a stacker, hopper-loader, or the like.

BACKGROUND OF THE INVENTION

Stackers and hopper-loaders commonly have sheets standing on edge, such as shown in the stacker patents U.S. Pat. Nos. 2,841,394 and 2,933,313. In both of those instances, a stack of sheets is being formed from an incoming stream of sheets, and there is required a movable backstop supporting the forward or advancing end of the stack. That backstop must be manually positioned by an operator, and also eventually removed when the stack itself is to be maneuvered.

One skilled in the art is also aware of positioning, in a hopper-loader, a bundle or stack of sheets which stand on their edges and which are advanced forward into a sheet-feeding presentation in the feeder itself. In that instance, it is commonly known that a backstop must again be employed for supporting the sheets in their edge-standing or generally upright position, and for advancing those sheets in the hopper-loader. Again, that requires the provision of a backstop and also the maneuvering of the backstop by an operator.

The present invention improves upon the prior art in that it employs means on the opposite sides of otherwise freestanding sheets in a stack or bundle, all to prevent the sheets from falling forward or backward and thereby moving out of the standing position in the bundle. The invention herein is accomplished by means of side supports for the bundle of sheets, which sufficiently engage the sheets, such as by either spring action or embedding of brush bristles or the like toward and between the sheets, or by a jagged or serrated type of edge which will engage the opposite sides of the sheets and prevent them from falling forward or backward However, the prior art is also aware of the utilization of brushes for controlling the edges of sheets, but only on the bottom of the sheets, rather than on opposite sides as in this invention. An example of that type of prior art is found in U.S. Pat. No. 3,718,217 where a bottom brush is utilized, though that brush is only for the retardation of the sheets, rather than supporting the sheets in their upstanding position, as in the present invention.

The present invention therefore provides apparatus which conveniently and in simplified manner supports a bundle of sheets in an upstanding position, by supporting the opposite sides of the sheets, and the support means itself can either be a stationary brush or serrated member or it can be of that construction but movable in the direction of the desired advancement of the bundle or stack of sheets.

BRIEF DESCRIPTION OF THE DRAWINGS

FIG. 1 is a side-elevational view of an embodiment of this invention.

FIG. 2 is a top-plan view of FIG. 1.

FIG. 3 is a side-elevational view of another embodiment of this invention.

FIG. 4 is a top-plan view of an embodiment of this invention.

FIG. 5 is an enlarged top-plan view of a fragment of FIG. 2.

FIG. 6 is a top-plan view of another embodiment of this invention and is showing a sheet related thereto.

DETAILED DESCRIPTION OF THE PREFERRED EMBODIMENTS

FIG. 1 shows a side-elevational view of one embodiment of this invention where bundles of upstanding sheets 10 and 11 are shown supported on a horizontally extending floor 12. The bundle 10 is shown to have just been deposited onto the floor 12 by means of a conventional type of crane 13 which is expandable and contractable, as indicated, and which has side arms 14 and 16 for engaging the opposite ends of the bundle 11, as shown. In the position shown, the crane 13 is being elevated upwardly away from the bundle 11, and it is taking the usual bundle end boards 17 and 18 with it. That is, the crane 13 has end board engagers 19 and 21 attached to the opposite ends 14 and 16 for engaging the end board 17 and 18 and thereby removing those end boards from the sheets which form the bundle 11.

That is, one skilled in the art will readily understand that the bundle 11 had/strap, such as the strap 22, which extended around the length of the bundle 11 and encompassed the end boards 17 and 18, in the usual manner. The bundle 11, with its end boards 17 and 18 and its strap 22 would be placed onto the floor 12, and the operator would then cut the strap 22 and remove the strap along with the removal of the end boards 17 and 18 by the crane 13. In that manner, the bundle can be readily and easily deposited on the floor 12, which may be a hopper-loader floor, and the bundle can then be released for maneuvering it along the floor 12 and into the operating mechanism which is not shown but would be to the left, as viewed in FIG. 1.

Further, a pusher 23 extends uprightly to span the bundle 11 at one end thereof, and it is on a cylinder 24 so that the pusher 23 can move leftwardly and engage the bundle 11 and slide it along the floor 12 and into abuttment with the bundle 10, all occurring after the crane 13 is moved out of the way and has taken the boards 17 and 18 with it. The mechanism 23 and 24 is suitably supported on the support 26 which may be based on a floor in any suitable fashion. Also, FIG. 2 shows that the floor 12 has openings, such as openings 27 through which the fingers or pusher 23 can extend to engage the rear edge 28 of the bundle 11 for the pushing mentioned.

FIGS. 1 and 2 further show that the mechanism includes side support members 29 and 31 which are parallel to the floor 12 and are spaced-apart, all as shown. In the embodiment of FIGS. 1 and 2, the side support members 29 and 31 are in the form of brushes having backing portions 32 and bristles 33 which extend toward each other across the floor 12, as shown in FIG. 2. The bristles 33 are relatively stiff brush bristles, with sufficient body and stiffness to give upstanding support for the sheets designated 34 in the bundles 10 and 11. The sheets are therefore standing on their lower edges and are standing upright, and the opposite sides of the sheets, that is at the extremities of the sheet width, are engaged by the bristles 33, and the sheets therefore are retained in their upright and edge-standing position. Also, the bristles 33 are sufficient to permit the bundles 10 and 11 to move along the floor 12, such as under the force of the pusher 23 and also under the force of conveyor belts 36 extending along the floor 12, if desired.

That is, the side supports 29 and 31 provide the upstanding support for the sheets in the bundles, and also permit the sheets in their bundle form to be slid along the floor 12, as indicated and as mentioned. In that manner, there is no need for anyone to hold the bundles upright or to manually slide them, nor is there any need for end supports or backstops supplied to the bundle. As seen in FIG. 1, the clamp 13, which is in the nature of an overhead crane, would position the bundle 11 onto the floor 12 and then remove the end boards 17 and 18 by means of the engagers which can be spring clips 19 and 21. Then, the pusher 23 can move the bundle 11 leftward until it abutts the end 37 of the first bundle 10, and then the two bundles continue to move leftward into the feeding operation in the usual hopper-loader mechanism. For that feed drive, there can be cleat or the like on the lower conveyors 36 which moves the bundle 11 leftward, and that would be a conventional arrangement. Also, the side members 31 could be movable, along with the conveyors 36 to support the opposite sides of the bundles or sheets and also to move them leftward. In that manner, FIG. 4 shows the side support members to be designated 38 and 39 and to be endless belts on pulleys 41 or the like so that the members move in the direction of the arrows shown for advancing the sheets, as mentioned. Also, the floor conveyors 42 would move in that same direction and at the same speed, all for advancing the bundles or sheets. The side members 38 and 39 of FIG. 4 are in the nature of brushes with bristles 43 extending thereon for engagement of the opposite side edges of the sheets in the bundles between the belts or brushes 38 and 39.

FIG. 3 shows a sheet stacker which is shown to include the incoming stacker belt 44 which conveys an incoming stream of sheets 46 into the upstanding stack 47, in the usual arrangement, such as in U.S. Pat. No. 2,933,313. In that arrangement, the stack 47 is growing, toward the right as viewed in FIG. 3, by virtue of the incoming stream 46, and the stack is supported on the floor 48 which may have a conveyor belt 49 thereon for moving rightwardly in the speed of the build-up of the stack 47. The invention then provides for the side support member 51 which is in the form of the brush previously described, or it may be in the form of the members to be described in connection with FIG. 6. Of course the arrangement in FIG. 3 would have two spaced-apart members 51 facing toward each with bristles or other irregular surface facing each other for purposes of engaging the opposite sides of the sheets in the bundle 47 and thereby retain the sheets in their edge-standing and upstanding position in that bundle 47. Again, the member 51 may be either stationary, or it may move rightwardly in synchronization with the growth of the stack 47. In any event, there is no requirement for any backstop, but nevertheless the sheets remain in their upstanding position in the bundle 47.

FIG. 5 shows a view of a brush 29 having its bristles 33 extending toward the sheets 34. In that display, it should be noticed that some of the bristles 33 will be flexed or bent, and other of the bristles 33 may penetrate to positions between adjacent sheets 34. In all events, the sheets 34 are retained in the upstanding position, but they are also free to be moved either by or relative to the brush 29, as described heretofore.

FIG. 6 shows an embodiment of the invention with its two spaced-apart side support members 52 and 53 again being spaced parallel to a floor, such as the floor 12 or 48, and being parallel to each other, as shown. In the embodiment of FIG. 6, the members 52 and 53 have a sawtooth or serrated pattern on their facing surfaces 54 and 56 respectively. The spacing between those faces 54 and 56 is such that the minimum space, such as from high point to high point on those surfaces, is less than the width of the sheets 34 shown adjacent thereto. Therefore, the sheets 34 will be securely gripped by the jagged or sawtooth faces 54 and 56 to be retained upright. Of course the jagged configurations 54 and 56 are in the horizontal plane, that is as viewed in the plan in FIG. 6, rather than in the vertical plane which would not permit the gripping or sawtooth presentation relative to the edges of the sheets 34. Again, the members 52 and 53 can either be stationary or they can be moving in the direction of movement of the stack which would be disposed therebetween.

In all embodiments, the sheet width is W, and the minimum distance between the side supports is M; and W is always greater than M, to render adequate sheets support. Side members 52 and 53 are constructed to have the appearance of members 29 or 51 in side view.

What is claimed is:

1. A support for unbound sheets standing on their edges in a bundle thereof, comprising a horizontal floor, a conveyor disposed on said floor for receiving and upwardly supporting the bundle of sheets in their edge-standing positions, two conveyor belts extending parallel to said floor and thereabove and spaced apart and each having flexible bristles extending toward the other of said conveyor belts and at the respective opposite sides of the bundle and with said bristles being adapted and spaced apart a distance sufficient to have said bristles in flexed contact with the sheets to maintain the sheets in their edge-standing positions on said floor and in an upright flat orientation on said conveyor, and said conveyor and said two conveyor belts all being movable in the same direction and at the identical speed for moving the bundle of sheets along said floor at said speed.

2. The support for unbound sheets standing on their edges in a bundle thereof, as claimed in claim 1, wherein said floor is that of a sheet feeder which is to be constantly supplied with the bundles of the sheets positioned on said floor, means for positioning bundles of the sheets on said floor and spaced-apart in a row extending between and parallel to said two conveyor belts, said bristles of said conveyor belts being of an extent and stiffness sufficient to uprightly support the sheets and to slide over the sheets of the first bundle in the row while simultaneously moving the second bundle in the row into contact with said first bundle, and powered means engageable with said second bundle in the row for sliding said second bundle along said floor and into contact with said first bundle.

3. The support for unbound sheets standing on their edges in a bundle thereof, as claimed in claim 2, wherein said means for positioning the bundles is a crane operative above said floor for lowering the bundles onto the floor between said two conveyor belts, and with the spacing of the tips of said bristles between said two conveyor belts being slightly less than the width of said bundles for the edge-standing support of the sheets by said two conveyor belts.

4. The support for unbound sheets standing on their edges in a bundle thereof, as claimed in claim 3, wherein said bundles each include an end board on opposite ends thereof, and board engagers on said crane for removing said end boards upon withdrawal of said crane.

* * * * *